US006955695B2

(12) United States Patent
Nahas

(10) Patent No.: US 6,955,695 B2
(45) Date of Patent: Oct. 18, 2005

(54) CONVERSION OF PETROLEUM RESIDUA TO METHANE

(75) Inventor: Nicholas Charles Nahas, Chatham, NJ (US)

(73) Assignee: Petro 2020, LLC, Chatham, NJ (US)

( * ) Notice: Subject to any disclaimer, the term of this patent is extended or adjusted under 35 U.S.C. 154(b) by 619 days.

(21) Appl. No.: 10/090,034

(22) Filed: Mar. 5, 2002

(65) Prior Publication Data

US 2003/0167691 A1 Sep. 11, 2003

(51) Int. Cl.[7] ..... C10J 3/16

(52) U.S. Cl. ..... 48/197 R; 48/202; 48/203; 48/206; 48/210; 423/180; 423/183; 423/185; 423/186; 423/187; 423/188; 423/191; 417/151; 417/152; 417/153

(58) Field of Search ..... 48/197, 202–210; 423/180–191; 417/151–153

(56) References Cited

U.S. PATENT DOCUMENTS 3,926,584 A * 12/1975 Adsetts ..... 48/214 R
4,094,650 A * 6/1978 Koh et al. ..... 48/197 R
4,459,138 A * 7/1984 Soung ..... 48/197 R
4,541,923 A * 9/1985 Lomas et al. ..... 208/164
5,628,623 A * 5/1997 Skaggs ..... 417/151
5,855,631 A * 1/1999 Leas ..... 48/197 R
6,506,361 B1 * 1/2003 Machado et al. ..... 423/659

* cited by examiner

*Primary Examiner*—Alexa Doroshenk
*Assistant Examiner*—Vinit H. Patel

(57) ABSTRACT

This invention discloses improvements on previous inventions for catalytic conversion of coal and steam to methane. The disclosed improvements permit conversion of petroleum residua or heavy crude petroleum to methane and carbon dioxide such that nearly all of the heating value of the converted hydrocarbons is recovered as heating value of the product methane. The liquid feed is distributed over a fluidized solid particulate catalyst containing alkali metal and carbon as petroleum coke at elevated temperature and pressure from the lower stage and transported to the upper stage of a two-stage reactor. Particulate solids containing carbon and alkali metal are circulated between the two stages. Superheated steam and recycled hydrogen and carbon monoxide are fed to the lower stage, fluidizing the particulate solids and gasifying some of the carbon. The gas phase from the lower stage passes through the upper stage, completing the reaction of the gas phase.

9 Claims, 1 Drawing Sheet

CONVERSION OF PETROLEUM RESIDUA TO METHANE

BACKGROUND OF THE INVENTION

The first step in the refining of crude petroleum (crude oil) is normally distillation to separate the complex mixture of hydrocarbons into fractions of differing volatility. Distillation requires heating to vaporize as much of the liquid as possible without exceeding an actual temperature of about 650° F., since higher temperatures lead to thermal decomposition. The fraction which is not distillable at 650° F. and atmospheric pressure is commonly further distilled under vacuum, such that an actual temperature of 650° F. can vaporize even more liquid, equivalent to a theoretical equivalent of 1050° F. at atmospheric pressure. The remaining undistillable liquid is referred to as petroleum residue, distillation residue, or simply "1050+resid." This fraction is of low value as a fuel because of its high viscosity and low volatility. Sulfur is concentrated in the residua typically to about 2.5 times the concentration of sulfur in the crude oil. Currently, petroleum residua are typically subjected to destructive thermal decomposition to yield cracked liquid and gas, and solid petroleum coke. The reactors for thermal decomposition are called cokers, and they may be fluidized bed reactors or stationary drums. Coker liquids require much upgrading by reaction with hydrogen to be blended with other petroleum products. Other outlets for residua include blending with lower viscosity distillates to make residual fuel oil, or use as paving or roofing asphalts.

However, since the residue fraction typically constitutes more than 20% by mass of the starting crude oil, there is high incentive to convert it to a clean burning fuel such as methane which may be fully substituted for natural gas or added to natural gas as a supplement.

Some crude oils yield on distillation more than 50% by mass of residue. Such crude oils are referred to as heavy crude oils, and it may be advantageous to convert such oils directly to methane without distillation or to perform only atmospheric pressure distillation and convert the atmospheric distillation residue to methane.

In addition to crude oil distillation residue and heavy crude oils, some petroleum refining processes such as catalytic cracking and fluidized bed coking have distillation steps which yield high boiling fractions which are typically coked, but might have higher value if converted to methane. For purposes of the present specification and claims, the term petroleum residue will be used to mean any such feedstock containing more than 50% residue which does not vaporize below an atmospheric pressure equivalent temperature of 1050° F.

The closest prior art related to the present invention is disclosed in several now expired patents: U.S. Pat. No. 3,958,957 (Koh, et al, May 25, 1976) teaches equilibrium limited methane formation from hydrogen and carbon monoxide in the presence of carbon-alkali metal catalysts. U.S. Pat. No. 4,077,778 (Nahas, et al, Mar. 7, 1978), and U.S. Pat. No. 4,094,650 (Koh, et al, Jun. 13, 1978), teach the alkali-metal catalyzed conversion of coal by reaction with steam to form methane and carbon dioxide in a substantially thermally neutral reaction effected by recycling the endothermic reaction products, hydrogen and carbon monoxide, so as to prevent their net formation in the reactor. The preferred temperature and pressure ranges such that methane is the only stable hydrocarbon and is produced at reasonable rates and concentrations are discussed by Nahas in *Fuel* Vol. 62:239–241 (February 1983). The Fuel article also describes the role of the reaction kinetics of catalyzed carbon gasification and the importance of achieving high steam conversion.

The '778 and '650 patents disclose that the process chemistry is applicable to carbonaceous feeds in general, but their detailed descriptions teach conversion of coal, and do not enable one skilled in the art to practice the conversion of liquid feeds such as petroleum residua without undue experimentation to determine appropriate means of mixing feed and catalyst, or relative amounts of feed and catalyst.

Results of the research leading to the development of the catalytic coal gasification process were published by Kalina and Nahas in DOE Report FE-2369-24 (December 1978). As reported therein and subsequently by Euker and Reitz in DOE Report FE-2777-31 (November 1981), it was found that the most effective way to contact coal and catalyst was to mix dried coal with an aqueous solution of alkali metal (preferably potassium) carbonate or hydroxide and subsequently dry the mixture to leave the equivalent of 10–20% potassium carbonate on the coal. Since coal typically contains about 10% inorganic mineral matter, the inorganic portion must be purged from the reactor, taking with it some unconverted carbon and all of the added catalyst. Clay minerals in the coal reacted with potassium to form kaliophilite, a catalytically inactive potassium aluminosilicate. Potassium was recovered from the purged solids by a combination of water washing and lime-water digestion, but as much as a third of the original catalyst remained irreversibly in the purged solids. The recovery and recycle of spent catalyst was therefore expensive and only partially effective.

The teachings of the prior art were based on coal for which the hydrocarbon portion of the feedstock is generally accompanied by 20% to 30% by weight of inorganic matter consisting of naturally occurring mineral matter in the coal plus the added alkali metal compound as catalyst. The reactor volume, and thus the catalyst holdup, were based on the solids residence time required for substantially complete gasification of the carbon before solids were purged from the reactor to prevent buildup of inorganic coal mineral matter. Reactors were thus sized for solids retention time. The rates of feed, steam, and recycle gas were determined by material balance, but this approach is not useful for determining the appropriate contacting of the feed, steam, and recycle gas to a substantially captive bed of catalyst for conversion of petroleum residua or heavy oil.

In addition, it was found that in fixed-bed batch experiments, the raw product gas was in chemical equilibrium with respect to methane, hydrogen, carbon monoxide, carbon dioxide, and unreacted steam. Steam conversion was kinetically limited and the reaction rate was found to be inhibited by reaction products. However, it was recognized that commercial reactors would need to utilize fluidized beds instead of fixed bed reactors, because fluidization is necessary to facilitate temperature control of the adiabatic reaction, to accommodate reasonable gas velocities at low pressure drops, and facilitate the feeding and withdrawing of solids. Unlike in fixed beds, the turbulent mixing in fluidized beds exhibits gas backmixing, a phenomenon which allows product gas to recirculate within the reactor and thereby inhibit the reaction rate throughout the reactor. In fluidized bed pilot plant experiments, the product methane and carbon dioxide were generally found to be at lower than equilibrium concentrations with hydrogen, carbon monoxide, and steam. Consequently it was determined that a single stage fluidized bed reactor would require longer solids residence times and reactor holdup than would be needed without gas backmixing.

The referenced U.S. Pat. No. 4,077,778 teaches a two-stage process for more complete gasification of coal particles, in which fine particles and overflow particles from a first stage are conveyed to a second stage for further reaction. In the '778 patent however, the two stages are in parallel with respect to the flow of the gasification medium. As a result, this two-stage configuration does not address the gas backmixing which has been found to inhibit the reaction rate with reaction products.

The increased carbon conversion taught by the '778 patent mitigates the loss of carbon in fine particulates entrained from the main fluidized bed reactor, but there remains the problem that fine particles are continuously generated by attrition and gasification in both stages. There is no means for particle growth by coalescence or agglomeration to offset the effects of attrition and gasification, and as a result, particles escaping from the second stage carry some carbon which is lost from the system.

BRIEF SUMMARY OF THE INVENTION

To address the limitations of the prior art, the present invention introduces improvements having the following objectives:

1. provide improved means of contacting feed with catalyst that reduces catalyst usage by more than 95% and eliminates the need for catalyst recovery,
2. disclose the preferred composition and amounts of catalyst-containing solids and provide means of control thereof,
3. enable the practice of the invention without undue experimentation to determine relative rates of steam and hydrocarbon feedstock to be injected into the reaction vessel, with respect to the mass and composition of catalyst-containing solids holdup in the reaction vessel,
4. provide a means of significantly reducing the effects of gas backmixing by staging the reaction system with respect to gas flow while allowing the catalyst-containing solids to circulate within the reaction system, and
5. control the size distribution of particulate solids.

The disclosed improvements permit conversion of petroleum residua or heavy crude petroleum to methane and carbon dioxide such that nearly all of the heating value of the converted hydrocarbons is recovered as heating value of the product methane.

The liquid feed is distributed over a fluidized solid particulate catalyst containing alkali metal and petroleum coke from the lower stage of a two-stage reactor and transported to the upper stage. Particulate solids containing petroleum coke and alkali metal are circulated between the two stages. Superheated steam and recycled hydrogen and carbon monoxide are fed to the lower stage, fluidizing the particulate solids and gasifying some of the carbon in the petroleum coke. The gas phase from the lower stage passes through the upper stage, completing the reaction of the gas phase. The ranges of temperature and pressure are selected such that methane is the only thermodynamically stable hydrocarbon. Feed rates of hydrocarbon and steam are determined by material balance and the holdup of active catalyst. Heat is recovered from the raw product gas, which is subsequently treated to remove entrained particulates, ammonia, unreacted steam, carbon dioxide, hydrogen sulfide, and carbonyl sulfide. Hydrogen and carbon monoxide are separated from the product methane, mixed with steam, superheated to a temperature above the reaction temperature, and recycled to the lower stage of the reactor.

DETAILED DESCRIPTION OF THE INVENTION

Figure 1:
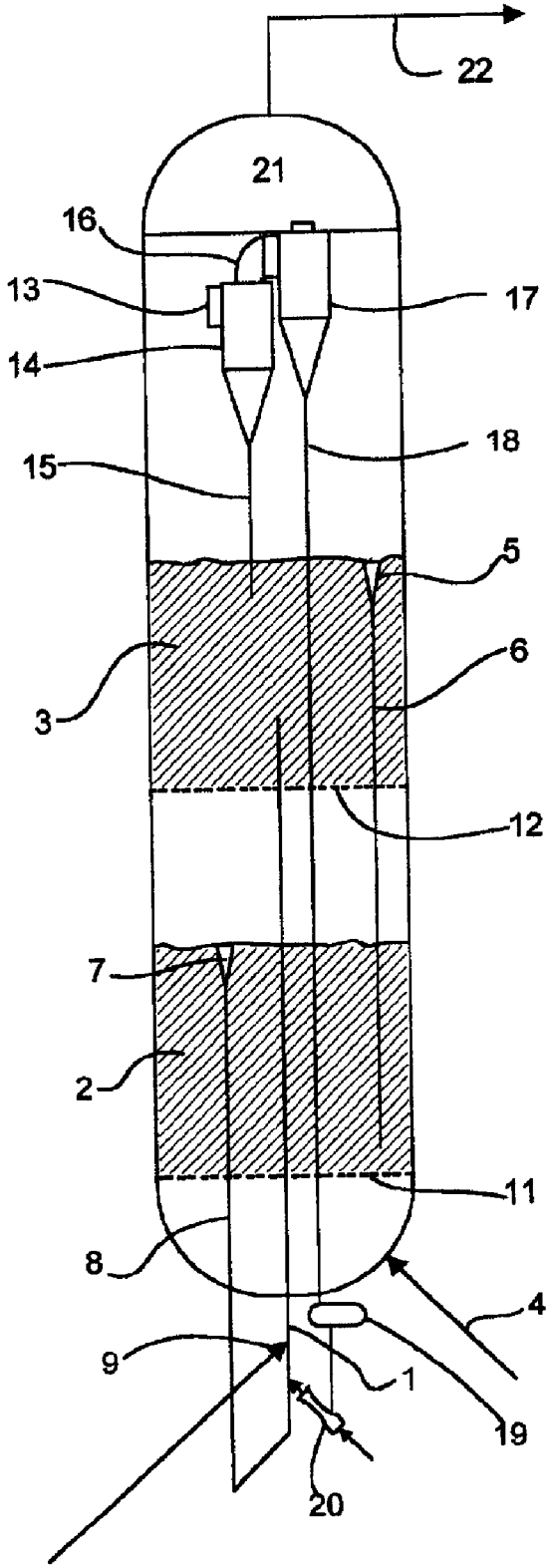
FIG. 1 is a schematic diagram showing the key features of the preferred gasifier configuration.

Petroleum residue or similar carbonaceous liquid feed is preheated to a temperature between 300° F. and 800° F. The feed is atomized and injected through one or more injectors into a gasification reactor system so as to distribute the feed over fluidized particulate solids which are circulated past the feed injectors. The reactor system is maintained at a pressure between 300 psig and 1000 psig, and at a temperature between 1100° F. and 1400° F. The particulate solids are fluidized by a superheated mixture of steam and recycled hydrogen and carbon monoxide. Upon contacting the hot solids, the liquid feed is thermally decomposed, primarily into methane, hydrogen, and solid petroleum coke. The petroleum coke consists primarily of amorphous carbon and high molecular weight condensed ring hydrocarbons, such that the overall hydrogen content of the coke is typically 2% to 4% by mass. Part of the steam reacts with the hydrocarbon portion of the feed to yield methane and carbon dioxide. Sulfur in the feed reacts with hydrogen and carbon monoxide to form hydrogen sulfide and trace concentrations of carbonyl sulfide. Nitrogen in the feed reacts quantitatively with hydrogen to form ammonia. The mixture of methane, carbon dioxide, unreacted steam, hydrogen, carbon monoxide, hydrogen sulfide, carbonyl sulfide and ammonia is withdrawn from the overhead of the reactor system. The preferred solids composition comprises 50%–60% petroleum coke, 40%–50% alkali metal, and 1%–10% other inorganic minerals.

Whereas in the gasification of coal, the preferred method of contacting the coal feed with the alkali metal compound consists of intimately mixing the coal feed with an aqueous solution of the alkali metal compound and subsequently drying the mixture to leave typically 15% by weight of alkali metal compound deposited on the coal, the preferred method in the present invention is to maintain a captive inventory of fluidized solids containing the alkali metal within the gasification reactor system. To prevent buildup if inorganic contaminants which may be present in the feed, it is preferred to periodically withdraw samples of the circulating solids, and to analyze the samples to ensure that the solids have an excess of alkali metal relative to other inorganic components. In particular, the mass of alkali metal in the circulating solids should be maintained at least two times, and preferably at least five times the mass of other inorganic constituents. The relative amounts of alkali metal and other inorganic constituents can be maintained at the desired proportions by periodically purging solids from the reactor and adding makeup alkali metal compound to increase the proportion of alkali metal to other inorganic constituents. By this means, the proportion of makeup catalyst compound relative to feed is reduced to less than 1% by mass in the present invention, preferably less than 0.2%, as opposed to the typical 15% disclosed in the prior art.

The methods of withdrawing solids from the reactor for sampling or purging is well known to those skilled in the art. The method taught by EP0102828 (1984), for example, may be employed.

It is common practice in petroleum refining to maintain petroleum residua in heated storage tanks equipped with agitators. For catalyst makeup rates of less than 0.2% by mass of the feed, the catalyst may be blended with the feed and maintained in suspension by agitation in such a heated storage tank. The required amount of makeup catalyst to be so blended may be estimated as five times the concentration of inorganic solids contained in the fresh feed. If more than 0.2% is required as, for example when the fresh feed contains more than 0.02% inorganic solids, it is preferred to add solid alkali metal compound as a powder to the circulating solids by means of a lock hopper or similar device. The preferred makeup catalysts are the carbonates or hydroxides of potassium, rubidium, or cesium and may be chosen based on availability and cost for the required makeup rate.

The preferred temperature and pressure of the gasification reactor system are similar to those used for coal gasification because the hydrocarbon reaction chemistry is quite similar. Specifically it is preferred to maintain the temperature between 1100° F. and 1400° F. It has been found that at temperatures below 1100° F., the reaction proceeds too slowly to permit the use of reasonable gasifier volumes, even when cesium, the most active of the alkali metals, is used as the active component of the catalyst. At temperatures above 1400° F. the ratio of methane to recycled hydrogen and carbon monoxide is too low, resulting in unreasonably high recycle rates.

The preferred pressure is between 300 and 1000 psig, more preferably between 400 psig and 600 psig. While the reaction rate is insensitive to pressure, lower pressures require handling larger volumes of gas, and higher pressures require more expensive equipment.

The primary net reaction in the steam gasification of coke in the presence of the alkali metal catalyst and recycled hydrogen and carbon monoxide may be written as $$2H_2O+2C \Rightarrow CH_4+CO_2 \quad (1)$$

This reaction is very slightly endothermic, and the required heat is supplied by superheating the steam and recycle gas above the desired reaction temperature.

Petroleum residua and similar hydrocarbon mixtures may be represented by an empirical formula of CHx, where x typically has a value of about 1.33; thus when properly balanced, the overall empirical formula reaction may be written $$1.5CHx+H_2O \Rightarrow CH_4+0.5CO_2 \quad (2)$$

The equilibrium limited steam conversion for this reaction is defined by the equilibrium of steam with carbon. At the preferred reaction conditions of 1300° F. and 500 psig, the gas composition corresponding to the overall reaction must also account for the presence of hydrogen and carbon monoxide. The equilibrium composition may be computed from any three independent reactions involving the components C, $H_2O$, $H_2$, CO, $CH_4$, and $CO_2$, subject to the two constraints of the ratio of methane to carbon dioxide given by reaction (2) above, and the sum of the partial pressures being equal to the total pressure. Thus for the following reactions:

$$H_2O+C \Rightarrow H_2+CO \quad K=1.79 \quad (3)$$

$$H_2O+CO \Rightarrow H_2+CO_2 \quad K=1.53 \quad (4)$$

$$3H_2+CO \Rightarrow CH_4+H_2O \quad K=0.0701 \quad (5)$$

Where the K's are equilibrium constants with partial pressures in atmospheres at 1300° F. Using these data, the equilibrium limited gas composition in the presence of carbon, excluding hydrogen sulfide and ammonia, is found to be as shown in Table 1.

TABLE 1

Graphite equilibrium limited gas composition at 1300° F. and 500 psig

| Component | Mole % |
|---|---|
| $H_2$ | 24.1 |
| CO | 6.5 |
| $CH_4$ | 25.6 |
| $CO_2$ | 12.8 |
| $H_2O$ | 30.9 |

A novel interpretation of the data published in DOE Report FE-2369-24 has now led to the discovery of a preferred solids composition required to achieve a specified steam conversion. Reactions (1), (3), and (4) provide a convenient means of describing the equivalent steam conversion corresponding to any gas composition. Reaction (1) shows the equivalence of 1 mole of $CH_4$ and 1 mole of $CO_2$ to 2 moles of converted $H_2O$, while Reaction (3) shows the equivalence of 1 mole of $H_2$ and 1 mole of CO to 1 mole of converted $H_2O$. Reaction (4) shows the equivalence of $H_2$ and CO by means of the water gas shift reaction, which does not change the total number of moles of $H_2$ plus CO, nor the total number of moles of $H_2O$ plus $CO_2$. Thus one may examine a gas composition containing $CH_4$, $CO_2$, $H_2$, and CO as if all of these components were produced from reactions of steam with carbon. Each mole of $CH_4$ in the product gas is equivalent to one mole of converted $H_2O$, as is each mole of $CO_2$, while each mole of CO or $H_2$ is equivalent to one half mole of converted steam. Using this method of assigning converted steam equivalents to other gas components, any gas composition containing $H_2O$, $H_2$, CO, $CH_4$, and $CO_2$ may be described in terms of an apparent or equivalent steam conversion. As an example, the composition of the equilibrium limited reaction product gas in Table 1 corresponds to an equivalent steam conversion of 63.5%.

However, in the practice of the present invention, $H_2$ and CO in product gas is the same as that introduced by recycling $H_2$ and CO mixed with fresh feed steam. Because the feedstock contains some hydrogen, the yield of $CH_4$ and $CO_2$ is a total of 1.5 moles from each mole of reacted steam as found by inspection of Reaction (2). The required composition of steam and recycled $H_2$ and CO is therefore found to be 64.8% $H_2O$, 27.7% $H_2$, and 7.5% CO. For purposes of estimating the effect of product inhibition of reaction kinetics, this feed gas composition may be viewed as starting with an apparent or equivalent steam conversion of 27.2%.

With a starting composition equivalent to 27.2% steam conversion, the gas phase proceeds toward an equilibrium composition corresponding to an equivalent steam conversion of 63.5%, with its progress slowing as it approaches the equilibrium limit. Because the equilibrium limit is defined by components in their standard states, and graphite is the standard state for carbon, the equivalent steam conversion described above is considered to be the graphite equilibrium limited steam conversion. However, it is possible to drive the reaction to higher equivalent steam conversion levels by its reaction with petroleum coke which contains amorphous carbon in a more active state than graphite. Nevertheless, it is desirable to approach the graphite equilibrium, because a gas composition equivalent to a higher steam conversion is thermodynamically unstable relative to graphite, and it is possible to precipitate carbon downstream of the reactor.

The practitioner of this invention may thus establish the objective of converting a desired quantity of steam from an equivalent conversion level of 27.2% to an equivalent conversion level of 63.5%, and determine the corresponding quantity of hydrocarbon feed required by material balance as indicated in reaction (2). The challenge for the practitioner is to determine without undue experimentation the required amount and composition of the solids holdup in the reactor for a desired feed rate of petroleum residue. Examination of pilot plant data in the light the foregoing interpretation of the reaction progress in terms of increasing equivalent steam conversion reveals that the preferred solids composition for the reaction at 1300° F. and 500 psig contains 50%–60% coke, preferably about 53%, and contains 40%–50% alkali metal, preferably about 43%, and contains 1%–10% other inorganic minerals, preferably about 4%.

If the alkali metal is potassium and the reactor is operated at the preferred temperature of 1300° F., the required reactor inventory of solids having the cited preferred composition, must provide 0.2 to 0.3 moles of potassium for each mole per hour of raw product gas. The petroleum residue may be fed at an hourly rate of 0.4 to 0.5 mass units for each mass unit of potassium, and by material balance the steam contained in the superheated mixture of steam and recycle gas will be required at a mass flow rate of 1.8 to 2.0 times the mass flow rate of the petroleum residue feed.

If a more active alkali metal is used, such as cesium or rubidium, the preferred way to take advantage of the increased activity is to lower the temperature to increase the concentration of methane in the raw product gas, and decrease the required recycle rate of hydrogen and carbon monoxide.

The preferred gasifier configuration in the present invention consists of two stages with respect to the gas flow, a lower stage and an upper stage. Unreacted steam from the lower stage passing through the upper stage continues to gasify coke in the upper stage at a slower reaction rate because the reaction rate is product inhibited. Two stages are preferred so that reaction products from the upper stage, including the thermal decomposition products, do not inhibit the reaction rate in the lower stage. If the whole reaction is carried out in a single stage fluidized bed as suggested by the prior art, the backmixing of product gas within the fluidized bed inhibits the reaction and limits the overall steam conversion. Of course the product inhibition may be further mitigated by using three or more stages at the expense of increased complexity.

The preferred reactor system may be better understood by reference to FIG. 1, a schematic diagram showing the key features of the gasification system. Feed is introduced into a riser 1, which circulates solids entrained in flowing gas from the lower stage 2 to the upper stage 3. Superheated steam and recycle gas are introduced into the bottom of the lower stage through line 4, and pass through grid 11 thereby fluidizing the solids in the lower stage.

Solids from the upper stage 3 are circulated to the lower stage 2 by means of an overflow well 5 and standpipe 6 which empties into the lower part of the lower stage. Solids from the lower stage are recirculated to the upper stage by means of an overflow well 7 and standpipe 8 which empties into the bottom of the riser 1. The riser is aerated with sufficient steam and recycle gas to entrain the overflow solids up the riser at a superficial velocity of 4 to 10 meters per second, preferably about 7 meters per second. The standpipes and riser are sized to circulate solids between the stages at a mass flow rate of about 10 times the mass flow rate of the injected feed. In the riser, solids are entrained past the feed injection nozzles 9 and discharged into the upper stage. Although there are similarities between this method of introducing feed to the method of feeding commonly practiced in catalytic cracking, the reasons for doing so are not obvious. In catalytic cracking, feed is introduced into the riser to mix with freshly regenerated catalyst. Essentially all the feed is vaporized and the vapor phase components undergo the cracking reactions by contacting the acid catalyst surface. All of the desired reaction takes place within a few seconds in the riser and the reaction is terminated by separating the catalyst from the product vapor at the end of the riser. In the present invention, only a negligible part of the catalytic reaction takes place in the riser. The purpose of adapting the catalytic cracking feed method to the present invention is to distribute the petroleum coke formed in the initial thermal decomposition uniformly over the catalytically active solids for later gasification in the two stages of fluidized beds. Indeed the standard practice for feeding petroleum residue to fluidized beds for other purposes, such as fluidized bed coking, is to inject the feed directly into the fluidized bed, relying on the bed turbulence to distribute the coke throughout the reactor.

In the lower stage, steam gasifies coke deposited on the solids, and the upflowing steam, recycle gas, and product gas pass upwardly through a second grid 12 to fluidize the solids in the upper stage. The raw product gas leaving the upper stage passes through cyclone separators 14 and 17 to remove entrained fine particles, and is discharged into plenum 21 from which it is withdrawn through overhead line 22. Heat is recovered from the raw product gas in a heat exchanger not shown on the drawing and may be used to preheat the mixture of steam and recycled hydrogen and carbon monoxide. The gas mixture is further cooled and scrubbed by processes commonly practiced in the petroleum industry to remove particulates, ammonia, and acid gases (carbon dioxide, hydrogen sulfide, carbonyl sulfide). Methane is cryogenically separated from hydrogen and carbon monoxide, and withdrawn as product, while the hydrogen and carbon monoxide are mixed with steam, superheated and recycled to the reactor inlet through line 4.

A further object of the present invention is to maintain a stable steady-state particle size distribution. To this end it is preferred to capture entrained fine particles from the raw product gas mixture leaving the upper stage as is commonly practiced with industrial fluidized bed reactors, by means of one or more pairs of cyclone separators, each pair consisting of a primary cyclone discharging into a secondary cyclone. Thus, with reference to FIG. 1, the raw product gas passes into inlet 13 of the primary cyclone 14 where the bulk of the entrained solids are captured and discharged back to the bed through dipleg 15. The outlet 16 of the primary cyclone discharges into the secondary cyclone 17 carrying the finest particles which escape capture in the primary cyclone. In the present invention the fine particles captured in the secondary cyclone are discharged downwardly from the bottom of the cyclone separator into a dipleg 18. The bottom of the dipleg discharges into a collection vessel 19 from which the solids are transported by means of a jet ejector 20 into the riser at a point below the feed injection nozzles. The jet ejector and motive fluid flow rate are sized to provide a downward flow of gas from the cyclone such that the superficial velocity in the dipleg is downward at 0.1 to 0.5 meters per second preferably about 0.3 meter per second. The fines are thus transported by a combination of gravity and low velocity gas flow to the collection vessel, and subsequently recycled by jet ejector into the riser.

The particle size distribution is thereby stabilized by counter-balancing events. Coarse particles break up into smaller particles by gasification and attrition, while fine particles are coalesced into larger particles by feed droplets in the riser.

The process of the present invention may further be better understood by considering the following more detailed quantitative example, again with reference to FIG. 1:

A commercial plant for the conversion of 25000 barrels per day of a typical petroleum residue to methane uses a feedstock having a specific gravity of 1.01 (8.9 API Gravity) containing 4.1% sulfur, 0.1% nitrogen, and 0.01% inorganic components by mass. The feedstock is stored at 300° F. in a heated and agitated tank not shown. In the storage tank, extra fine grade potassium carbonate (80% through 325 mesh) is added to the feedstock to a concentration of 0.09% by weight. The feedstock is preheated to a temperature of 600° F. in a heat exchanger not shown and fed at about 550 psig through an array of four radially spaced feed injectors 9 into riser 1. A portion of the steam and recycled hydrogen and carbon monoxide (about 5%) is also introduced through the feed injectors to atomize the liquid feed. The design feed rate corresponds to 25.5 lb/sec (11.6 kg/sec) for each of the four injectors. Solids are circulated through standpipe 8 and riser 1 at about 1020 lb/sec (about 460 kg/sec). The riser is aerated with about 5% of the steam and recycle gas below the feed injectors 9 including the motive gas from ejector 20. Above the feed injectors 9, the inside diameter of the riser 1 is about 2 feet (about 0.6 m), so that the circulating solids are transported upwardly at a velocity of about 20 ft/sec (about 6 m/sec) discharging into the upper stage 3. The liquid feed undergoes rapid thermal decomposition in the riser 1 yielding primarily hydrogen, methane, and petroleum coke. The petroleum coke is uniformly distributed as a coating on the entrained particles.

The gasifier is a refractory lined pressure vessel having an inside diameter of about 30 feet (about 9.1 meters) and having two fluidized bed stages 2 and 3, each having a depth of about 40 feet (about 12 meters), supported by grids 11 and 12 which allow the upflowing gases to pass through, fluidizing the solid particles. Solids inventory is controlled by monitoring the depth of the lower stage 2 so as to maintain overflow well 7 lightly submerged below the surface, ensuring a continuous supply of circulating solids, and withdrawing solids as necessary to allow a disengaging space below grid 12. The normal solids withdrawal rate will be about 920 lb/hr (about 420 kg/hr). The heating value of the petroleum coke in the withdrawn solids represents only about 0.2% of the heating value of the feed. The level of solids in the upper stage 3 is controlled by overflow well 6 which discharges excess inventory into the lower stage 2. The total inventory of solids required is about 880 tons (about 800 metric tonnes), having a composition of 53% petroleum coke, 43% potassium, and 4% other inorganic constituents by mass. The withdrawn solids are periodically analyzed to ensure that they are more than 50% coke, more than 30% potassium and less than 10% other inorganic constituents. Withdrawal rates and catalyst addition rates may be adjusted maintain the preferred composition.

The gasifier pressure is maintained at about 500 psig (about 34 barg) at plenum 21 by means of a back pressure regulator not shown, located on product gas line 22 downstream of heat recovery and gas scrubbing facilities not shown. About 90% of the steam and recycled hydrogen and carbon monoxide stream is preheated to about 1100° F. by heat exchange with the raw product gas from line 22 and superheated to about 1450° F. in a gas fired furnace not shown, then fed through line 4 to the gasifier below grid 11. The actual outlet temperature of the superheat furnace is adjusted to control the gasifier temperature at plenum 21 at about 1300° F.

Under these conditions, about 190 lb/sec (about 88 kg/sec) of total steam is required to be fed to the gasifier, mixed with about 4.5 lb-moles/sec (about 2.1 kg-moles/sec) hydrogen and about 1.25 lb-moles/sec (about 0.57 kg-moles/sec) carbon monoxide recovered from the product gas. The composition of the feed gas mixture introduced into the bottom of the gasifier is thus 64.7% steam, 27.7% $H_2$, and 7.6% CO.

The raw product gas rises from the top of the upper stage 3 at a superficial velocity of about 1.1 ft/sec (about 0.33 m/sec) and passes into the inlet 13 of primary cyclone 14 where most of the entrained particles are captured and returned to the fluidized bed 3 through dipleg 15. The finest entrained particles not captured in the primary cyclone 14 are carried into the inlet 16 of secondary cyclone 17 where they are discharged through dipleg 18 into collection vessel 19 and subsequently to the inlet of jet ejector 20 from which they are recycled to riser 1 below feed injectors 9. These finest of entrained particles are thus captured by fresh liquid feed droplets and increase in size, being coated with petroleum coke. The raw product gas, substantially free of entrained particles flows upwardly from secondary cyclone 17 into plenum chamber 21 and is withdrawn from the gasifier overhead through line 22. Although for clarity the drawing shows only one pair of cyclones, a unit of this capacity would typically have four pairs of cyclones in parallel, all discharging raw product gas into the plenum chamber. Likewise the secondary cyclone diplegs would discharge into a single common collection vessel connected to the jet ejector inlet.

The composition of the raw product gas withdrawn through line 22 is 25.6% $CH_4$, 12.8% $CO_2$, 23.9% $H_2$, 6.6% CO, 30.2% unreacted $H_2O$, 0.7% $H_2S$, 0.2% $NH_3$, and trace COS. The total raw gas flow rate is about 19.1 lb-moles/sec (about 8.7 kg-moles/sec). Heat is recovered from the raw product gas and used to preheat steam and recycle gas, generate steam, and preheat feedstock by well known methods which are not part of this invention. Likewise the gas scrubbing and separations methods are well known in the art, and are not included in the specification.

What I claim as my invention is:

1. A process for the conversion of petroleum residua to methane comprising the steps of:

preheating a petroleum residue feedstock to a temperature between 300° F. and 800° F.;

injecting the preheated feedstock into a reaction vessel maintained at a temperature between 1100° F. and 1400° F. and at a pressure between 300 psig and 1000 psig, wherein the reaction vessel contains fluidized solid particles comprising:

more than 50% by mass petroleum coke;

more than 30% and less than 50% by mass alkali metal, wherein the alkali metal is selected from the group consisting of potassium, rubidium, cesium, or any mixture thereof; and less then 10% by mass of other inorganic constituents, wherein the fluidized solid particles are fluidized by an upwardly flowing gaseous mixture at the bottom of the reaction vessel comprising:

more than 50% steam;

more than 20% and less than 40% hydrogen; and more than 3% and less than 20% carbon monoxide, wherein the gaseous mixture is preheated to a temperature in excess of 1300° F., wherein the mass flow rate of the steam of the gaseous mixture is maintained at between 1.8 and 2.0 times the mass flow rate of the injected preheated feedstock, and wherein the hourly mass flow rate of the injected preheated feedstock is maintained at between 0.3 and 0.6 times the mass of the alkali metal;

withdrawing from the reaction vessel a gaseous product mixture comprising unreacted steam, methane, carbon dioxide, hydrogen, carbon monoxide, hydrogen sulfide and ammonia;

recovering methane from the gaseous product mixture; and recovering hydrogen and carbon monoxide; and recycling the recovered hydrogen and carbon monoxide into the upwardly flowing gaseous mixture at the bottom of the reaction vessel.

2. The process of claim 1, wherein the composition of the fluidized particles in the reaction vessel is maintained within the specified range of more than 50% by mass petroleum coke; more than 30% and less than 50% by mass alkali metal; and less than 10% by mass other organic constituents, by periodically withdrawing solids and adding alkali metal compound to the reaction vessel.

3. The process of claim 2, wherein the alkali metal compound is dispersed as a fine powder admixed with the petroleum residue feedstock at a concentration of less than 1% by mass, maintained in suspension by agitation, and injected into the reaction vessel with the preheated injected feedstock.

4. The process of claim 1, wherein the reaction vessel consists of at least two stages, an upper and lower stage, wherein the upwardly flowing gaseous mixture is fed into a lower stage, and wherein the solid fluidized particles are circulated between the upper and lower stages.

5. The process of claim 4, wherein the solid fluidized particles are circulated from upper to lower stages by one or more standpipes, and the solid fluidized particles are circulated from lower to upper stages by one or more aerated risers.

6. The process of claim 5, wherein the preheated petroleum residue feedstock is injected into at least one aerated riser.

7. The process of claim 6, wherein the mass flow rate of the fluidized solid particles in the aerated riser is between 5 and 20 times the mass flow rate of the injected preheated feedstock.

8. The process of claim 6, wherein the gaseous product mixture is withdrawn through at least one pair of cyclone separators in series, the series of cyclone separators consisting of a primary cyclone separator and secondary cyclone separator, wherein the primary cyclone separator discharges into the inlet of a secondary cyclone separator, wherein each cyclone separator is equipped with a pipe dipleg at the bottom apex of its conical section to discharge the collected fine particles separated from the gaseous product mixture, and wherein the dipleg of the secondary cyclone separator discharges into a collection zone coupled to the inlet of a jet ejector and wherein the jet ector discharges the collected fine particles into the riser below the level of the feedstock injection.

9. The process of claim 8, wherein the jet ejector is operated with sufficient motive fluid to induce a down-flow of gas and entrained solids in the dipleg of the secondary cyclone separator, wherein the gas and solids proceed downwardly with a superficial velocity of more than 0.1 meter per second and less than 1 meter per second.

* * * * *